US010401771B2

(12) United States Patent
Yano

(10) Patent No.: US 10,401,771 B2
(45) Date of Patent: Sep. 3, 2019

(54) IMAGE FORMING APPARATUS AND CONTROL METHOD WHICH GENERATES COLOR PROCESSING CONDITION

(71) Applicant: CANON KABUSHIKI KAISHA, Tokyo (JP)

(72) Inventor: Takaaki Yano, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/986,624

(22) Filed: May 22, 2018

(65) Prior Publication Data

US 2018/0348685 A1 Dec. 6, 2018

(30) Foreign Application Priority Data

May 31, 2017 (JP) ..... 2017-108240

(51) Int. Cl.
*G03G 15/00* (2006.01)
*G03G 15/01* (2006.01)

(52) U.S. Cl.
CPC ..... *G03G 15/5062* (2013.01); *G03G 15/01* (2013.01); *G03G 15/5041* (2013.01); *G03G 2215/00037* (2013.01); *G03G 2215/00042* (2013.01)

(58) Field of Classification Search
CPC ..... G03G 15/01; G03G 15/5041; G03G 15/5062; G03G 2215/00037; G03G 2215/00042
See application file for complete search history.

(56) References Cited

U.S. PATENT DOCUMENTS

2013/0343774 A1* 12/2013 Ikeda ..... G03G 15/5062 399/49
2018/0348685 A1* 12/2018 Yano ..... G03G 15/01

FOREIGN PATENT DOCUMENTS

JP 2003-65852 A 3/2003
JP 2009-004865 A 1/2009

* cited by examiner

*Primary Examiner* — Ryan D Walsh
(74) *Attorney, Agent, or Firm* — Canon USA, Inc., IP Division

(57) ABSTRACT

An image forming apparatus, to which an external measurement device is connectable, including an image processor, a printer, a sensor arranged on a conveyance path, a controller that performs first processing for generating color processing condition based on a measurement result of measurement images of the sensor, the measurement images including a first measurement image and a second measurement image, wherein a length of the second measurement image in a conveyance direction is longer than a length of the first measurement image in the conveyance direction, and performs second processing for generating conversion condition, based on a measurement result of predetermined measurement images by the sensor and measurement data output from an external measurement device, wherein a length of a predetermined measurement image included in the predetermined measurement images in the conveyance direction is longer than the length of the first measurement image in the conveyance direction.

12 Claims, 11 Drawing Sheets

IMAGE FORMING APPARATUS AND CONTROL METHOD WHICH GENERATES COLOR PROCESSING CONDITION

BACKGROUND

Field of the Disclosure

The present disclosure generally relates to image forming and, more particularly, to an image forming apparatus and control method which generates color processing condition, and to generation processing of generating a color conversion condition based on a measurement result of a measurement image acquired by a measurement unit.

Description of the Related Art

In recent years, there has been provided an image forming apparatus including a measurement unit that is for measuring a measurement image formed on a sheet and is arranged on a conveyance path for conveying a sheet. This image forming apparatus can adjust an image forming condition based on a measurement result of the measurement image acquired by the measurement unit.

Further, an image processing apparatus to which a general purpose colorimetric device is connectable has been also known. The above-described image forming apparatus can adjust the image forming condition, based on a color chart measurement result by the general purpose colorimetric device.

However, in the image forming apparatus capable of adjusting the image forming condition by using any one of the measurement unit and the colorimetric device, a measurement value acquired through measurement of the color chart may vary because of difference in characteristics of the measurement devices.

Therefore, conventionally, with respect to the difference in measurement values caused by the difference in characteristics of the measurement devices, there has been provided a method of reducing the difference in characteristics by executing correction between the devices. Examples may include a method where a correction coefficient is acquired from a relationship between measurement values acquired by measuring a color chart through a colorimetric device as a reference and a colorimetric device as a correction target. In an image processing method described in Japanese Patent Application Laid-Open No 2003-65852, the same color chart (hereinafter, referred to as "common color chart") is measured by different colorimetric devices.

In order to measure the common color chart using the colorimetric devices of different types, the image forming apparatus has to print a common color chart having a layout appropriate for each of the colorimetric devices. Herein, a measurement unit arranged on a conveyance path and a sensor connectable to the image forming apparatus have different rules for measuring the color chart. For example, because the measurement unit measures the color chart conveyed along the conveyance path, a precise rule is specified with respect to a position and a size of a measurement image formed on the color chart. In other words, with the color chart which is provided in consideration for color measurement to be executed by only a certain colorimetric device, there is a possibility that measurement cannot be executed by a different colorimetric device.

SUMMARY

The present disclosure provides improvements to image forming in various configurational aspects.

According to one or more aspects of the present disclosure, an image forming apparatus to which an external measurement device is connectable, includes an image processor configured to perform image processing to image data, a printer configured to print an image on a sheet based on the image data, a sensor arranged on a conveyance path for conveying the sheet on which the image is formed and configured to measure a measurement image printed on the sheet by the printer, and a controller configured to execute first processing for generating a color processing condition to be used for the image processing, based on a measurement result acquired by the sensor from measurement images printed by the printer, the measurement images including a first measurement image and a second measurement image, wherein a length of the second measurement image in a conveyance direction is longer than a length of the first measurement image in the conveyance direction, and execute second processing for generating a conversion condition, based on a measurement result acquired by the sensor from predetermined measurement images printed by the printer, wherein a length of a predetermined measurement image included in the predetermined measurement images in the conveyance direction is longer than the length of the first measurement image in the conveyance direction, wherein the first processing includes: a first printing task that controls the printer to print the measurement images on a first sheet, a first measuring task that controls the sensor to measure the measurement images on the first sheet, a conversion task that converts a first measurement result of the measurement images based on the conversion condition, the first measurement result being acquired by the sensor, and a first generation task that generates the color processing condition based on the converted first measurement result, wherein the second processing includes: a second printing task that controls the printer to print the predetermined measurement images on a second sheet, a second measurement task that controls the sensor to measure the predetermined measurement images on the second sheet, and a second generation task that generates the conversion condition based on a second measurement result acquired by the sensor from the predetermined measurement images and measurement data output from an external measurement device, and wherein the measurement data corresponds to a measurement result acquired by the external measurement device from the predetermined measurement images on the second sheet.

Further features of the present disclosure will become apparent from the following description of exemplary embodiments with reference to the attached drawings.

BRIEF DESCRIPTION OF THE DRAWINGS

FIGS. 10A, 10B, 100, and 10D are schematic diagrams illustrating transition of an operation screen.

DESCRIPTION OF THE EMBODIMENTS

Exemplary embodiments of the present disclosure will be described below with reference to the drawings.

<Configuration of Image Forming Apparatus>

Figure 1:
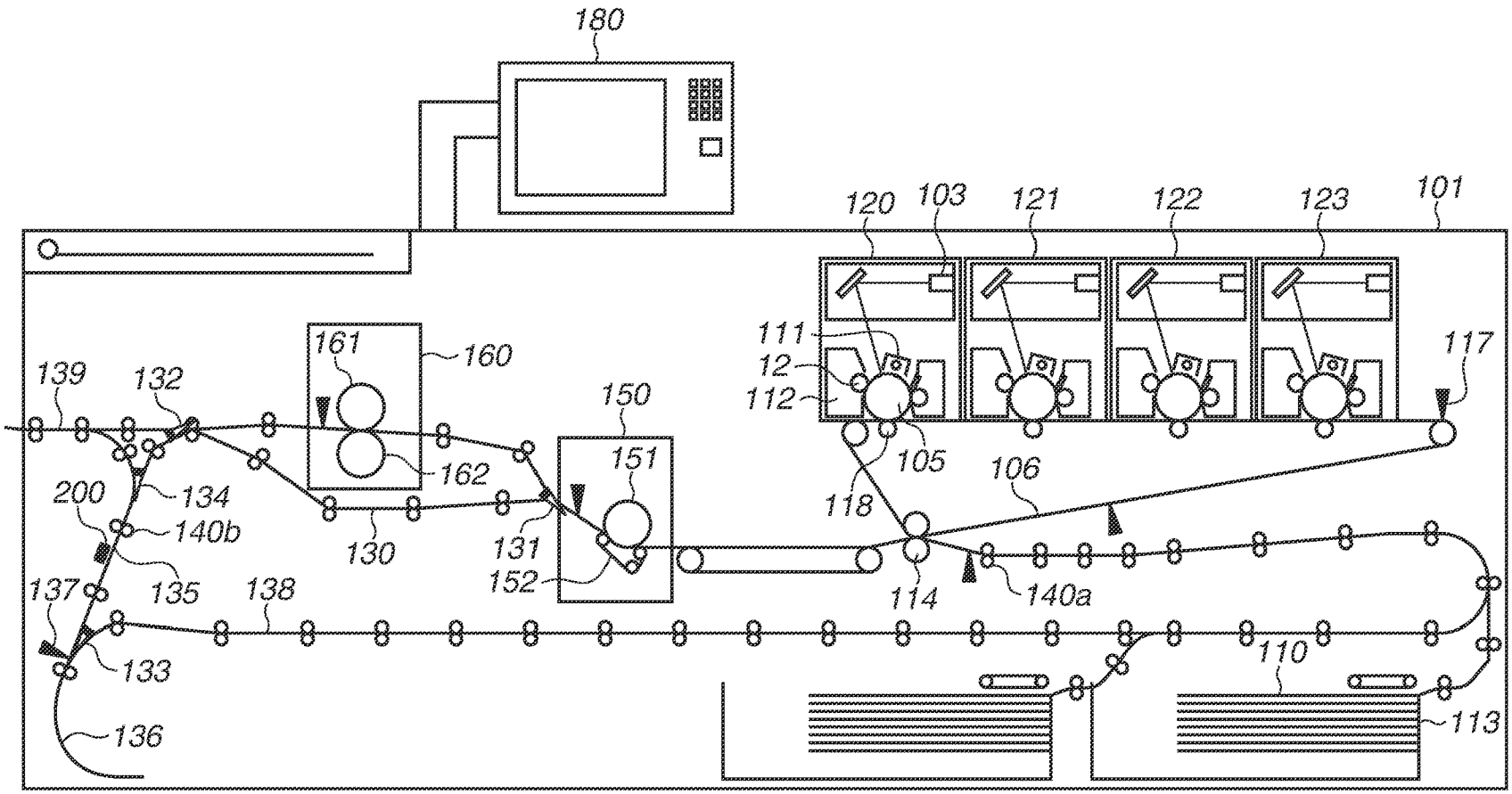
FIG. 1 is a diagram schematically illustrating a cross-sectional view of an image forming apparatus.

An image forming apparatus according to one or more aspects of the present disclosure will be described with reference to FIG. 1. An image forming apparatus 100 includes a printer 101 and an operation unit 180. The printer 101 includes four stations 120, 121, 122, and 123 each for forming an image of a different color component. The station 120 forms a yellow image, the station 121 forms a magenta image, the station 122 forms a cyan image, and the station 123 forms a black image.

A configuration of the station 120 that may form, among a variety of images, a yellow image, will be described below because configurations of the respective stations 120 to 123 are similar to each other. A photosensitive drum 105 is a photosensitive member having a photosensitive layer on a surface thereof, which is charged by a charging unit 111. An exposure device 103 that is controlled based on image data scans the photosensitive drum 105 with laser, so that an electrostatic latent image is formed on the photosensitive drum 105. A development unit 112 includes a container portion which contains developer including toner and a magnetic carrier and a development sleeve 12 which is arranged inside the container portion and rotationally driven while bearing the developer. The development unit 112 uses the developer to develop the electrostatic latent image and forms a toner image. The photosensitive drum 105 is an example of an image bearing member that bears an image formed by the printer 101. Further, the charging unit 111 and the exposure device 103 function as a latent image forming unit that forms an electrostatic latent image.

A primary transfer roller 118 transfers a toner image formed on the photosensitive drum 105 to an intermediate transfer belt 106 when a transfer voltage is applied thereto by a power source unit (not illustrated). Toner images of respective colors formed by the stations 120, 121, 122, and 123 are transferred onto the intermediate transfer belt 106 in a superimposed manner, so that a full-color toner image is borne on the intermediate transfer belt 106. The toner image borne on the intermediate transfer belt 106 is conveyed to a secondary transfer roller 114 through the rotation of the intermediate transfer belt 106. The intermediate transfer belt 106 is an example of a transfer member which bears an image formed by the printer 101.

A sensor 117 which detects light reflected from a detection image formed on the intermediate transfer belt 106 is arranged in a periphery of the intermediate transfer belt 106. Based on the light reflected from the detection image detected by the sensor 117, the image forming apparatus 100 corrects an image forming condition to make densities of images formed by the stations 120, 121, 122, and 123 be target densities.

A sheet 110 stored in a storing container 113 is conveyed by a conveyance roller 140*a* toward the secondary transfer roller 114 while a conveyance timing thereof is adjusted with that of the toner image borne on the intermediate transfer belt 106. The secondary transfer roller 114 transfers the toner image borne on the intermediate transfer belt 106 to the sheet 110 when a transfer voltage is applied to the secondary transfer roller 114. Then, the sheet 110 on which the toner image is transferred is conveyed to the fixing units 150 and 160.

The fixing units 150 and 160 apply heat and pressure to the toner image transferred to the sheet 110 to fix the toner image to the sheet 110. The fixing unit 150 includes a fixing roller 151 having a heater for heating the sheet 110 and a pressure belt 152 for pressing the sheet 110 against the fixing roller 151. The fixing unit 160 is arranged on a downstream side of the fixing unit 150 in a conveyance direction of the sheet 110. The fixing unit 160 applies a gloss to the toner image on the sheet 110 that has passed through the fixing unit 150. The fixing unit 160 includes a fixing roller 161 having a heater for heating the sheet 110 and a pressure roller 162.

The sheet 110 that has passed through the fixing unit 150 is conveyed to the fixing unit 160 when an image is to be fixed to the sheet 110 in a gloss application mode, or when an image is to be fixed to the sheet 110 of, for example, a thick paper that uses a large amount of heat for fixing the image. When the image is to be fixed to the sheet 110 of, for example, a standard paper or a thin paper, the sheet 110 that has passed through the fixing unit 150 is conveyed along a conveyance path 130 that bypasses the fixing unit 160. An angle of a flapper 131 is controlled to cause the sheet 110 to be conveyed to the fixing unit 160 or to bypass the fixing unit 160.

A flapper 132 is a guiding member which switches the sheet 110 to be guided to a conveyance path 135 or to a discharging conveyance path 139. The sheet 110 conveyed along the conveyance path 135 is conveyed to an inverting portion 136. When an inverting sensor 137 arranged on the conveyance path 135 detects a trailing end of the sheet 110, a conveyance direction of the sheet 110 is inverted.

A flapper 133 is a guiding member which switches the sheet 110 to be guided to a conveyance path 138 for executing both-sides image formation or to the conveyance path 135. If a face-down mode is executed, the sheet 110 is conveyed to the conveyance path 135 again, and discharged from the image forming apparatus 100.

On the other hand, if a two-sided printing mode is executed, the sheet 110 is conveyed to the secondary transfer roller 114 again along the conveyance path 138. When the two-sided printing mode is executed, the sheet 110 is switched backward at the inverting portion 136 after an image is fixed to the first face thereof and conveyed to the secondary transfer roller 114 along the conveyance path 138, so that an image is formed on the second face thereof.

A flapper 134 is a guiding member which guides the sheet 110 to a conveyance path for discharging the sheet 110 from the image forming apparatus 100. When the sheet 110 is discharged in the face-down mode, the flapper 134 guides the sheet 110 switched backward at the inverting portion 136 to the discharging conveyance path. The sheet 110 conveyed along the discharging conveyance path is discharged from the image forming apparatus 100.

Color sensors 200 for measuring density of the measurement image on the sheet 110 are arranged on the conveyance path 135. The conveyance roller 140*b* conveys the sheet 110 along the conveyance path 135. Two color sensors 200 are arranged in a direction orthogonal to the conveyance direction of the sheet 110, so that two rows of measurement images can be detected thereby.

The operation unit 180, which may include one or more processors and one or more memories, may include a display and a key input unit. For example, the display is a liquid crystal display. For example, the key input unit includes a start button, a cancel button, a menu button, a numerical keypad, and a mode selection button. The operation unit 180 serves as an interface which allows the user to input a number of printing sheets or a printing mode of the image. The user uses the operation unit 180 to select between a one-sided printing mode and a two-sided printing mode, execute a face-down mode, or select between a monochromatic mode and a color mode. If the operation unit 180 is a touch-panel display, the operation unit 180 does not have to include the key input unit.

The units described throughout the present disclosure are exemplary and/or preferable modules for implementing processes described in the present disclosure. The term "unit", as used herein, may generally refer to firmware, software, hardware, or other component, such as circuitry or the like, or any combination thereof, that is used to effectuate a purpose. The modules can be hardware units (such as circuitry, firmware, a field programmable gate array, a digital signal processor, an application specific integrated circuit or the like) and/or software modules (such as a computer readable program or the like). The modules for implementing the various steps are not described exhaustively above. However, where there is a step of performing a certain process, there may be a corresponding functional module or unit (implemented by hardware and/or software) for implementing the same process. Technical solutions by all combinations of steps described and units corresponding to these steps are included in the present disclosure.

Figure 2:
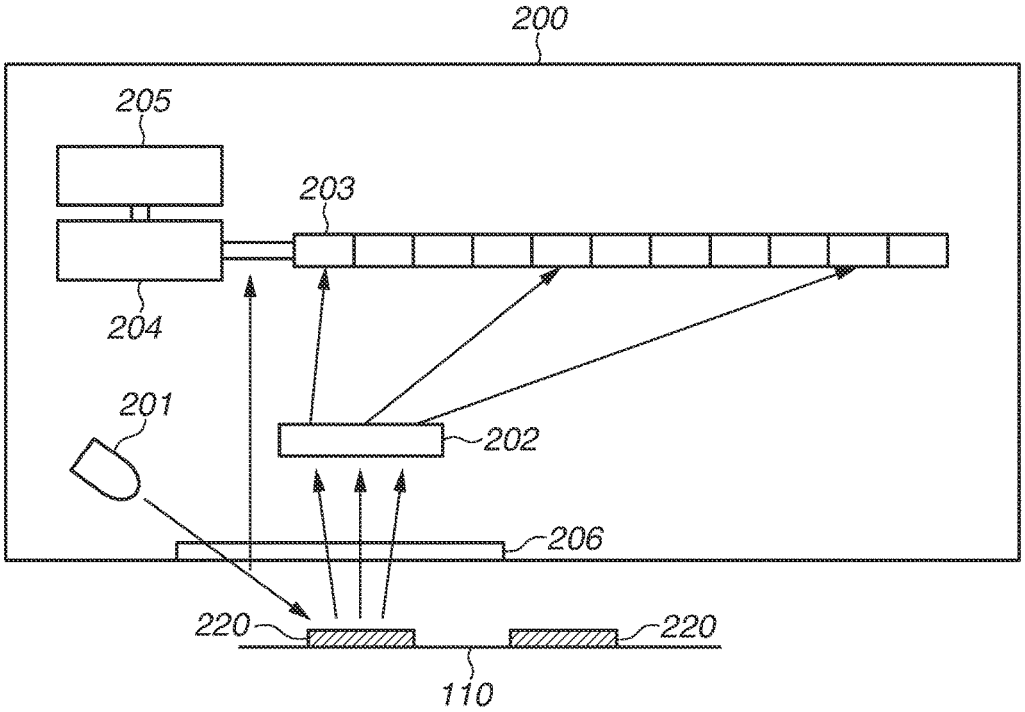
FIG. 2 is a diagram schematically illustrating a cross-sectional view of a color sensor arranged on a conveyance path.

FIG. 2 is a diagram illustrating a configuration of the color sensor 200. A white light-emitting diode (LED) 201 is a light-emitting element which emits light to a measurement image 220 on the sheet 110. A diffraction grating 202 is a spectroscopic part which separates light reflected from the measurement image 220 at each wavelength. A line sensor 203 is a light detection element having n-pieces of light receiving elements for detecting the light separated at each wavelength by the diffraction grating 202.

A calculation unit 204 executes various kinds of calculation from a light intensity value of a pixel detected by the line sensor 203. A memory 205 stores various data used by the calculation unit 204. For example, the calculation unit 204 executes calculation of a spectrum from a light intensity value, or calculation of Lab values. Data such as spectral data, chromaticity data, or density data is measured by the color sensor 200. The color sensor 200 of the present exemplary embodiment outputs the spectral data (L*, a*, and b*).

Further, a lens 206 which collects light emitted from the white LED 201 onto the measurement image 220 on the sheet 110 or collects light reflected from the measurement image 220 onto the diffraction grating 202 can be also arranged on the color sensor 200.

<Control Block Diagram>

Figure 3A:
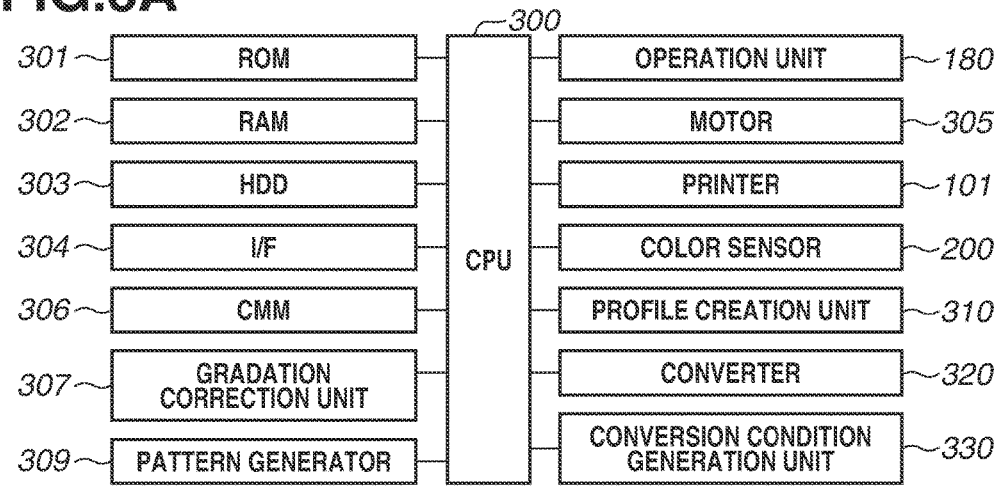
FIG. 3A is a control block diagram of the image forming apparatus.

A control block diagram of the image forming apparatus 100 will be described with reference to FIG. 3A. A central processing unit (CPU) 300, which may include one or more processors and one or more memories, may be a control circuit (controller) which controls each unit of the image forming apparatus 100. A read only memory (ROM) 301 stores a control program necessary for executing various processing illustrated in the below-described flowchart executed by the CPU 300. A random access memory (RAM) 302 is a system work memory for the CPU 300 to execute operations.

A hard disk drive (HDD) 303 stores image data included in a print job, a gradation correction table (y look-up table (LUT)), and various color charts. In addition, although the image forming apparatus 100 of the present exemplary embodiment includes the HDD 303, an external storage device, such as a secure digital (SD) card or a flash memory, can be connected thereto in place of the HDD 303.

An external device is connected to an interface (I/F) 304, so that the I/F 304 executes communication with the external device connected thereto. For example, the I/F 304 is a port to which a universal serial bus (USB) terminal can be connected. In below description, a colorimetric device 400 is connected as the external device. The I/F 304 transmits an operation instruction to the colorimetric device 400 and receives a measurement result acquired by the colorimetric device 400. In other words, the I/F 304 acquires measurement data corresponding to a measurement result acquired by the colorimetric device 400.

A motor 305 is a driving source for driving conveyance rollers 140*a* and 140*b*, and a flapper arranged on the conveyance path. The printer 101, the operation unit 180, and the color sensor 200 have already been described, and thus description thereof will be omitted.

Figure 3B:
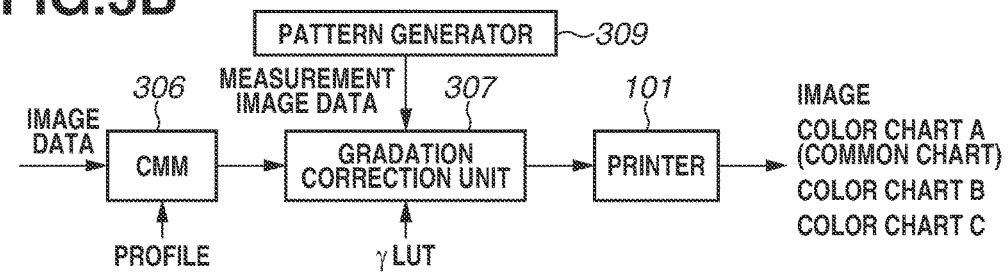
FIG. 3B is a schematic diagram illustrating a relationship of data input and output through image processing.

Image processing which the image forming apparatus 100 executes to form an image will be described with reference to FIG. 3B. When the image forming apparatus 100 forms a color image, image data (RGB (red-green-blue) signal value) is input thereto from a host computer (not illustrated). The image data can be an image signal intended for a CMYK (cyan-magenta-yellow-black) signal value according to a printing standard, such as the Japan Color.

A color management module (CMM) 306 converts image data from RGB to L*a*b or from CMYK to L*a*b. The CMM 306 further executes color conversion based on profile data (inputting profile). The profile is, for example, a one-dimensional look-up table (LUT) for controlling a gamma value of an input image signal of image data, a multi-color LUT called as "direct mapping", or a one-dimensional LUT for controlling a gamma value of generated conversion data. By using the above tables, the input image signal is converted from a color space dependent on a device to image data (L*a*b*) that is not dependent on the device. The profile corresponds to a color processing condition for converting an input color space to an output color space.

The CMM 306 executes GAMUT conversion or light source type mismatch color conversion (i.e., mismatch of color temperature setting) with respect to image data converted to a L*a*b* colorimetric system. Mapping of mismatch between an input color space and an output color reproduction range of the image forming apparatus 100 is executed through the GAMUT conversion. With this processing, the input color space of the image data is converted to the output color space. The light source type mismatch color conversion is color conversion for adjusting mismatch between a type of light source at the time of input and a type of light source at the time of observing an output object. Through the above processing, image data (L*a*b) is converted to image data (L*'a*'b*'). Color conversion of the image data (L*'a*'b*') is executed based on the profile data (output profile). With this processing, the image data (L*'a*'b*') is converted to a CMYK signal dependent on the output device (image forming apparatus 100) and output to a gradation correction unit 307.

The gradation correction unit 307 executes various types of image processing on the input image data (CMYK signal) to correct the image data. Density of an image (output image) formed by the printer 101 will not be a desired density. Therefore, the gradation correction unit 307 corrects an input value (image signal value) of the image data to make the density of the output image formed by the printer 101 be a desired density. For example, the gradation correction unit 307 corrects the image data based on the gradation correction table (γ LUT) stored in the HDD 303. The gradation correction table are stored in the HDD 303 for each color. The gradation correction table (γ LUT) corresponds to a gradation correction condition for correcting the image data.

The image data converted by the CMM 306 is input to the printer 101 via the gradation correction unit 307. The printer 101 forms an image on the sheet 110 based on the input image data. In addition, the CMM 306 and the gradation correction unit 307 are realized by an image processor. In order to clearly describe the functions of the image processor, in the control block diagram of the present exemplary embodiment, the functions of the image processor have been divided and described as different blocks, i.e., the CMM 306 and the gradation correction unit 307. Further, as a variation example of the image processor, the image processor can realize the function of the CMM 306, whereas an application specific integrated circuit (ASIC), or similarly configured circuitry, can realize the function of the gradation correction unit 307.

The pattern generator 309 outputs measurement image data to the printer 101. The printer 101 forms a color chart on the sheet 110 based on the measurement image data output from the pattern generator 309. The image forming apparatus 100 described in the present exemplary embodiment can form a plurality of types of color charts. The image forming apparatus 100 of the present exemplary embodiment forms at least three types of color charts, i.e., color charts A, B, and C. Each of the color charts A, B, and C corresponds to a pattern image.

The profile creation unit 310 executes characterization (multi-color calibration) for creating a multi-color LUT for suppressing fluctuation of multi-color. For example, the profile creation unit 310 of the present exemplary embodiment creates an international color consortium (ICC) profile. Alternatively, the profile creation unit 310 can create a color matching profile other than the ICC profile. For example, the profile creation processing executed by the profile creation unit 310 is described in Japanese Patent Application Laid-Open No. 2009-004865. Accordingly, description of the profile creation processing will be omitted.

Herein, assume that the user would like to execute calibration processing for adjusting the color of the image (output image) printed on the sheet 110 by the image forming apparatus 100, by using the colorimetric device 400 different from the color sensor 200. For example, the colorimetric device 400 is a spectroscopic sensor that measures spectral data (L*, a*, and b*). The colorimetric device 400 is, for example, "i1Pro2" (registered trademark) manufactured by X-Rite Inc.

When the user executes calibration processing by using the colorimetric device 400, the user has to manually operate the colorimetric device 400. Therefore, in the image forming apparatus 100 of the present exemplary embodiment, the converter 320 can convert a measurement result of the color sensor 200 into measurement data of the colorimetric device 400.

With this configuration, the image forming apparatus 100 can simulate a measurement result of the optional colorimetric device 400 from the measurement result of the color sensor 200. Therefore, the user does not have to perform troublesome operation of the colorimetric device 400 every time the calibration processing is executed.

Further, there is a possibility that a correlative relationship between the measurement data of the colorimetric device 400 and the measurement result of the color sensor 200 is changed. Therefore, the image forming apparatus 100 executes update processing for updating the above-described conversion table. The conversion condition generation unit 330 generates the above-described conversion table based on the measurement result of the common chart acquired by the colorimetric device 400 and the measurement result of the common chart acquired by the color sensor 200. The common chart corresponds to a second pattern image.

Figure 4:
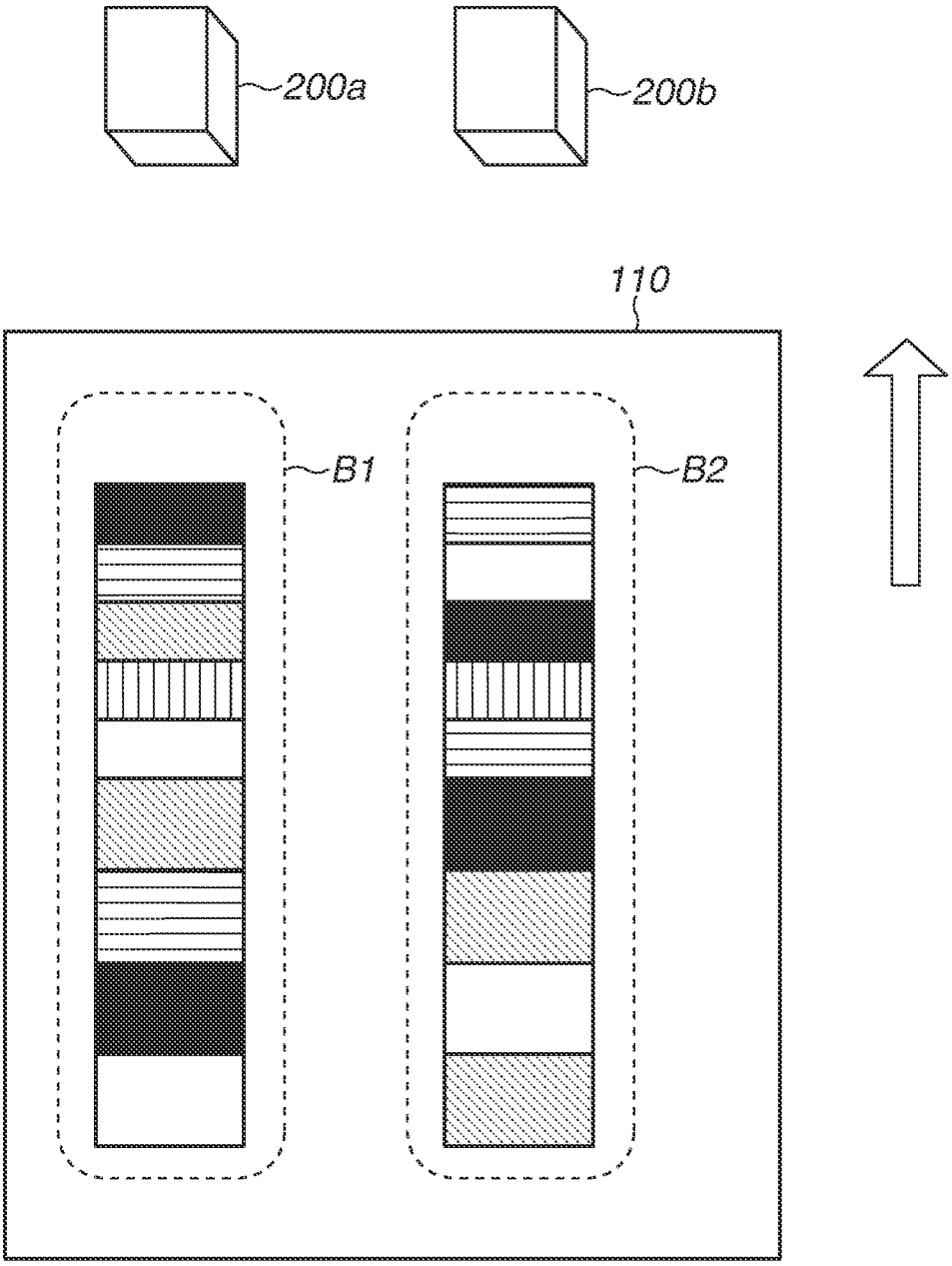
FIG. 4 is a schematic diagram illustrating a measurement method using a color sensor.

FIG. 4 is a diagram schematically illustrating a state where the color chart is measured by the color sensors 200. The color sensors 200 are arranged on the conveyance path 135 of the image forming apparatus 100. The color sensors 200 includes a color sensors 200*a* and 200*b*. However, a number of the color sensors 200 can be one, or three or more. In FIG. 4, the conveyance direction of the sheet 110 is indicated by an arrow.

The color chart B in the present exemplary embodiment includes color charts B1 and B2 formed at different positions in a direction orthogonal to a direction in which the sheet 110 is conveyed. When the sheet 110 on which the color chart B is printed passes measurement positions of the color sensors 200, the color sensor 200*a* measures the color chart B1, and the color sensor 200*b* measures the color chart B2. The color chart B corresponds to a first pattern image.

Figure 5:
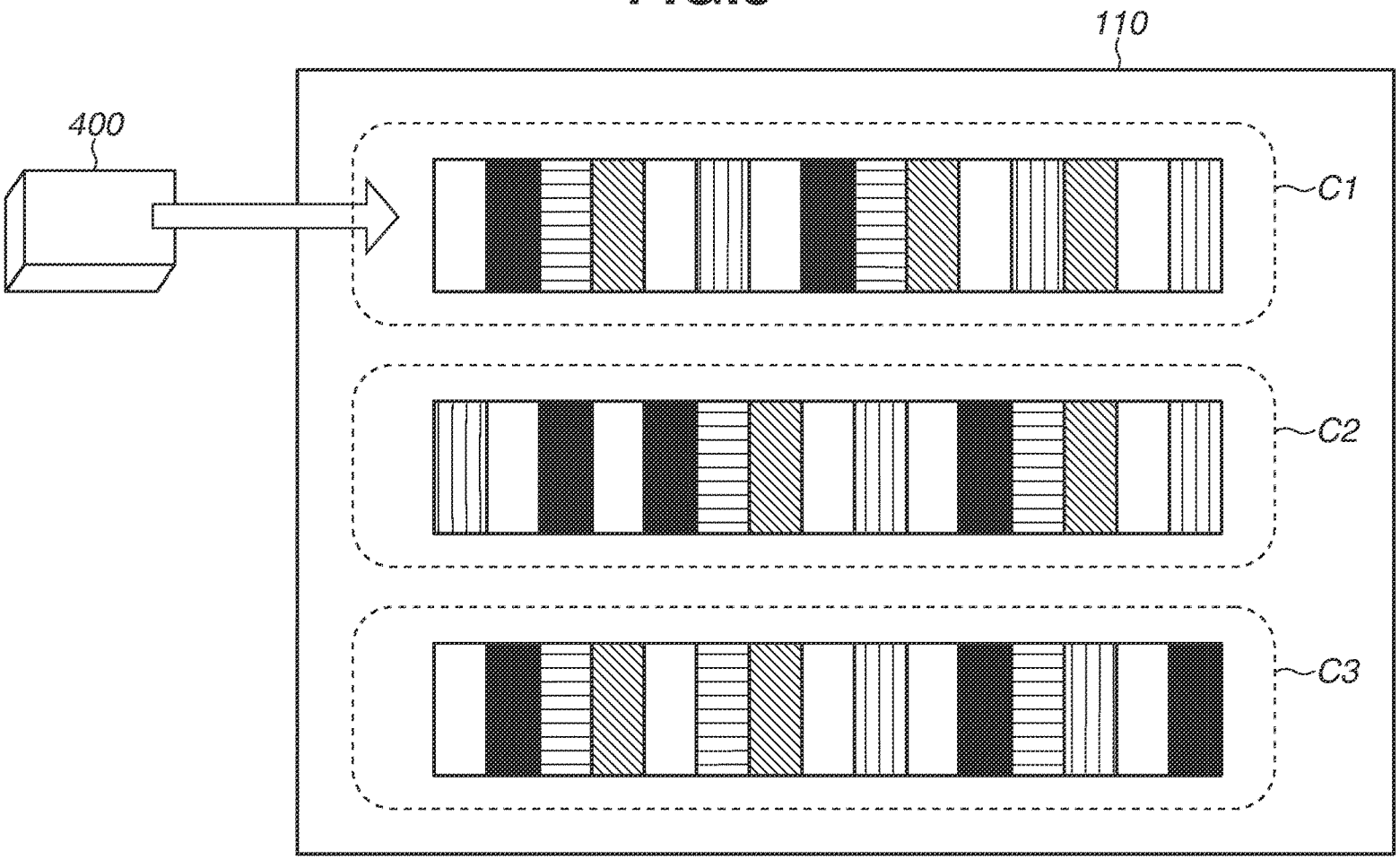
FIG. 5 is a schematic diagram illustrating a measurement method using a colorimetric device.

FIG. 5 is a diagram schematically illustrating a state where the color chart is measured by the colorimetric device 400. An arrow in FIG. 5 indicates a moving direction in which the user moves the colorimetric device 400.

The colorimetric device 400 is connected to the image forming apparatus 100 via a USB cable, and the user moves the colorimetric device 400 to a measurement point on the color chart to measure the measurement point. Therefore, the user places the sheet 110 on which the color chart C is printed on a horizontal table and moves the colorimetric device 400 along the color chart C. With this operation, the colorimetric device 400 acquires measurement data of the color chart C.

The color chart C in the present exemplary embodiment includes a plurality of color charts C1, C2, and C3. The color charts C1, C2, and C3 are formed and arranged at different positions on the sheet 110. Although the color chart C on which three rows of measurement images are arranged has been described, measurement images of any number of rows can be arranged thereon.

<Calibration Processing>

Figure 6:
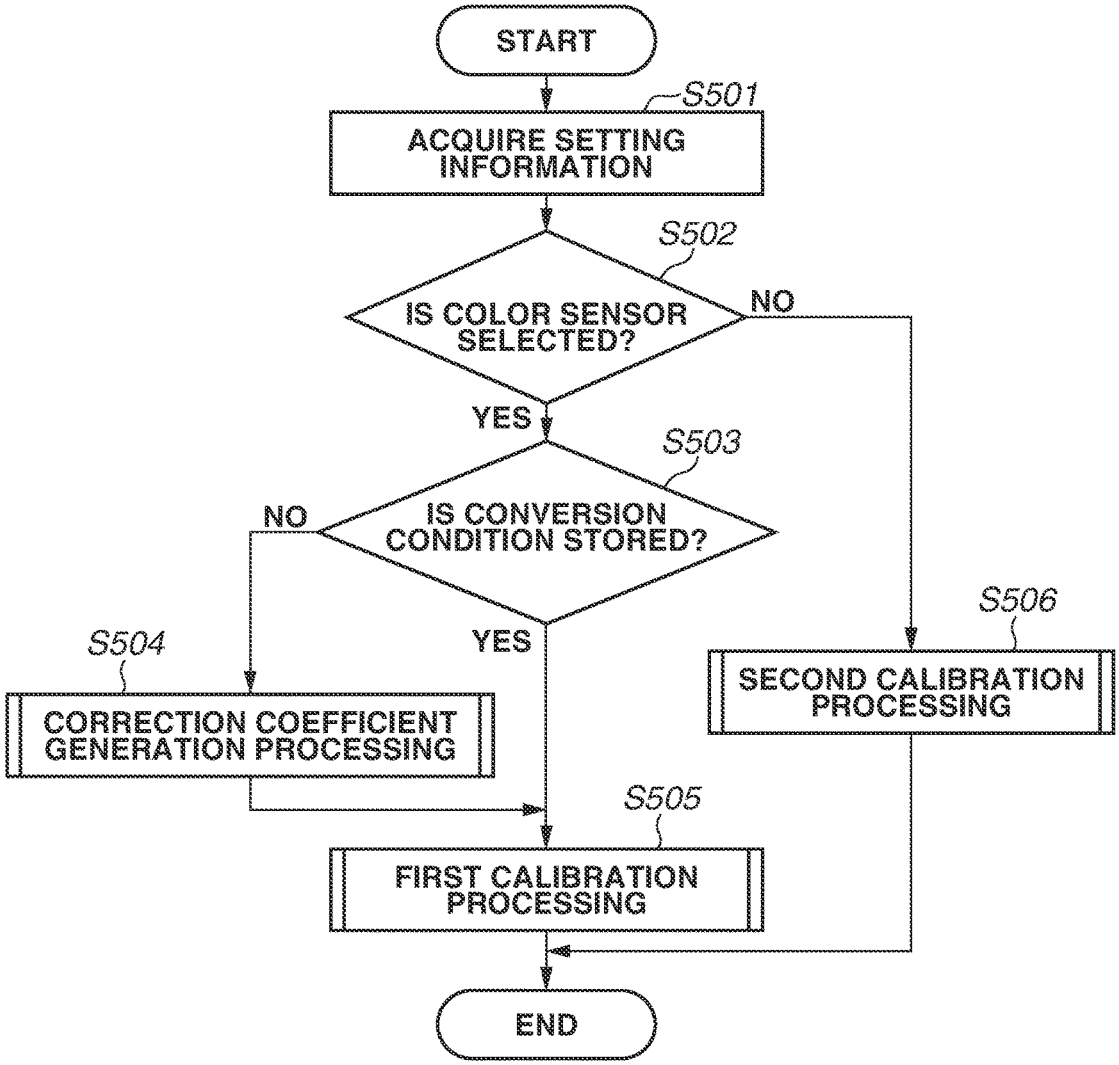
FIG. 6 is a flowchart illustrating calibration processing.

FIG. 6 is a flowchart illustrating calibration processing for creating a profile. The CPU 300 reads a program stored in the ROM 301 to the RAM 302 to execute the flowchart illustrated in FIG. 6. The calibration processing in FIG. 6 is started when the user inputs a calibration execution instruction through the operation unit 180.

Figure 10A:
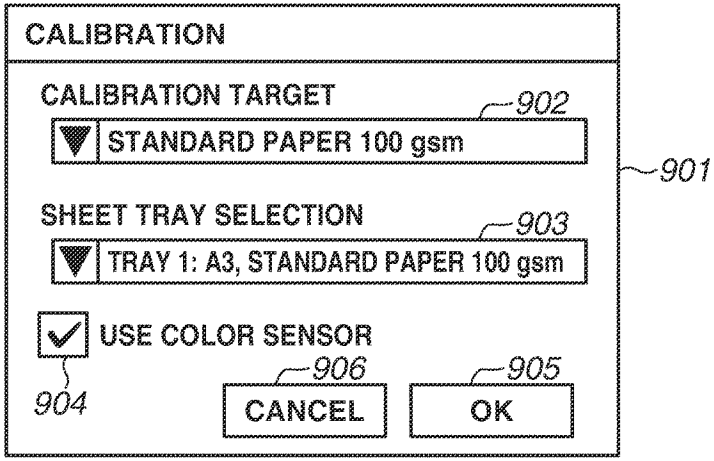

FIG. 10A is a diagram schematically illustrating a screen of the operation unit 180 for accepting the calibration execution instruction. A screen 901 is displayed on a liquid crystal panel of the operation unit 180. The image forming apparatus 100 accepts settings for executing calibration from the user through the screen 901. A type of sheet (target sheet) to be used for the calibration is displayed in a cell 902. A pull-down menu is spread when the user selects the cell 902. A plurality of pre-stored sheet types is displayed on the pull-down menu in a selectable state. For example, the target sheet varies according to a type or a grammage of the sheet 110. A sheet feeding source of the target sheet is displayed in a cell 903. A pull-down menu is spread when the user selects the cell 903. For example, a manual feed tray or the storing container 113 is displayed on the pull-down menu.

The user selects whether to execute calibration using the color sensor 200 through a checkbox 904. If the checkbox 904 is ticked, the image forming apparatus 100 forms a color chart B on the sheet 110 in the calibration processing. In this case, a measurement operation is executed by the color sensor 200 before the sheet 110 on which the color chart B is printed is discharged from the image forming apparatus 100.

On the other hand, if the checkbox 904 is not ticked, the image forming apparatus 100 forms a color chart C on the sheet 110 in the calibration processing. In this case, the measurement operation is not executed by the color sensor 200 even if the sheet 110 on which the color chart C is printed is discharged from the image forming apparatus 100.

An OK button 905 is a button for inputting an execution instruction of the calibration processing. When the user presses the OK button 905, the CPU 300 starts the processing of the flowchart in FIG. 6. A cancel button 906 is a button for inputting a cancellation instruction of the calibration processing. When the cancel button 906 is pressed, the CPU 300 switches the screen 901 displayed on the operation unit 180 to a home screen without executing the calibration processing.

In step S501, the CPU 300 acquires setting information for executing the calibration accepted in the screen 901. Then, in step S502, the CPU 300 determines whether to execute the calibration processing using the color sensor 200. In a case where the checkbox 904 is ticked (YES in step S502), the processing proceeds to step S503.

In step S503, the CPU 300 determines whether a conversion table of the target sheet is generated. In step S503, in a case where correction information (conversion table) for the colorimetric device 400 corresponding to the target sheet is stored in the HDD 303, the CPU 300 determines that the conversion table of the target sheet is generated. The conversion table of the target sheet is correlation data of the measurement result of the measurement image on the target sheet acquired by the color sensor 200 and a measurement result of a measurement image on the target sheet acquired by the colorimetric device 400.

On the other hand, in step S503, in a case where the correction information (conversion table) for the colorimetric device 400 is not stored in the HDD 303, the CPU 300 determines that the conversion table of the target sheet is not generated.

Figure 10B:
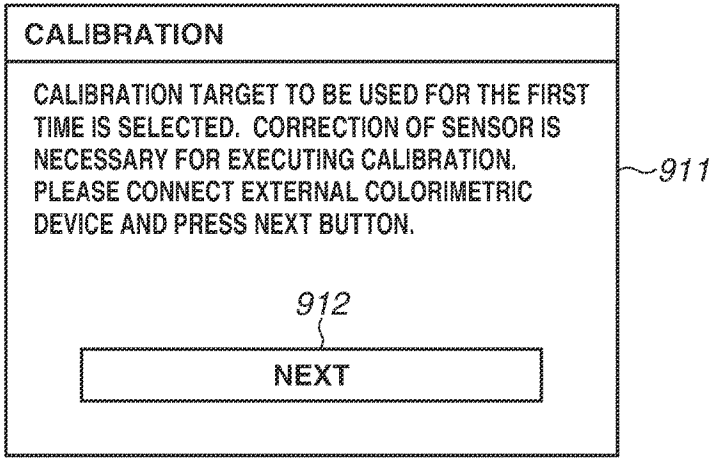

FIG. 10B is a diagram schematically illustrating a screen 911 displayed on the operation unit 180 when the conversion table for correcting the correlation data of the color sensor 200 and the colorimetric device 400 is not generated with respect to the target sheet. In a case where the correction information about the sensors does not exist with respect to the target sheet, the CPU 300 displays the screen 911 on the operation unit 180 to notify the user that generation of the correction information is necessary. When the user presses a button 912, the processing proceeds to step S504. Generation processing of the correction information in step S504 will be described below with reference to FIG. 7.

Further, in step S503, in a case where the correction information (conversion table) for the colorimetric device 400 corresponding to the target sheet is stored in the HDD 303 (YES in step S503), the processing proceeds to step S505. In step S505, the CPU 300 executes the first calibration processing. In the first calibration processing, a profile is created based on a measurement result, of the color chart B formed on the sheet 110, acquired by the color sensor 200. With this processing, a profile is newly stored in the HDD 303. The CPU 300 completes creation of the profile and ends the calibration processing.

Further, in step S502, in a case where the checkbox 904 is not ticked (NO in step S502), the processing proceeds to step S506. In step S506, the CPU 300 executes the second calibration processing. In the second calibration processing, a profile is created based on a measurement result, of the color chart C formed on the sheet 110, acquired by the colorimetric device 400. With this processing, a profile is newly stored in the HDD 303. The CPU 300 completes creation of the profile and ends the calibration processing.

<Sensor Correction Coefficient Creation Processing>

Figure 7:
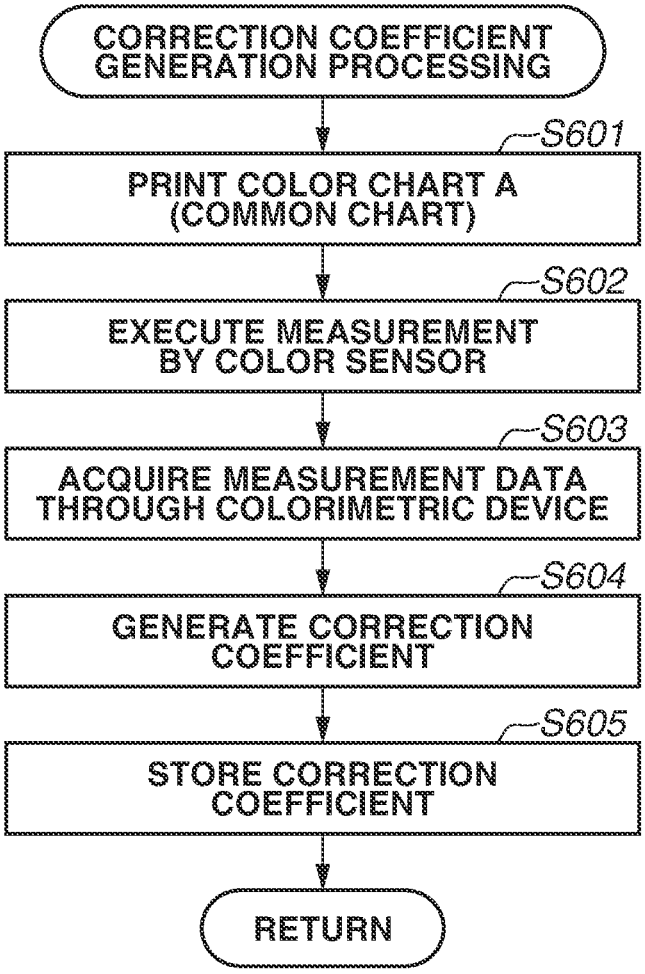
FIG. 7 is a flowchart illustrating conversion condition generation processing.

FIG. 7 is a flowchart illustrating generation processing of the correction information. Hereinafter, the generation processing of the correction information (i.e., sensor correction coefficient generation processing) executed in step S504 will be described with reference to FIG. 3D and FIG. 7.

When the sensor correction coefficient generation processing is executed, in step S601, the CPU 300 controls the printer 101 to form the color chart A (common chart) on the sheet 110. The CPU 300 controls the pattern generator 309 to transfer the measurement image data corresponding to the color chart A to the printer 101 via the gradation correction unit 307. Through the control, the printer 101 forms the color chart A on the sheet 110 based on the measurement image data. The color chart A is readable by both of the color sensor 200 and the colorimetric device 400. A layout of the color chart A (common chart) will be described below with reference to FIG. 11A.

Then, in step S602, the CPU 300 guides the sheet 110 on which the color chart A is formed to the conveyance path 135 and measures spectral data of the color chart A through the color sensor 200. The spectral data acquired by the color sensor 200 is transmitted to the conversion condition generation unit 330.

In step S603, the CPU 300 waits for the measurement data (second measurement data) acquired by the colorimetric device 400 to be received via the I/F 304. In step S603, the CPU 300 displays a guidance for explaining a measurement procedure of the color chart A on the liquid crystal display of the operation unit 180.

Figure 10C:
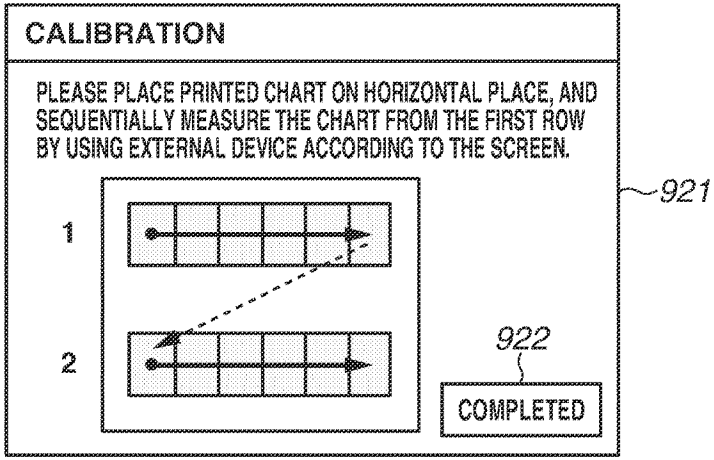

FIG. 10C is a diagram schematically illustrating a screen 921, which is for explaining a measurement procedure to the user, displayed on the liquid crystal display. The screen 921 is displayed on the liquid crystal display of the operation unit 180 when the "NEXT" button 912 is pressed at the screen 911, and the processing in steps S601 and S602 has been completed. The user measures the color chart A according to the guidance displayed on the screen 921. When the measurement of the color chart A is completed, the user presses a button 922. After the button 922 is pressed, the CPU 300 advances the processing to step S604.

In step S604, the conversion condition generation unit 330 calculates a correction coefficient based on the measurement results of the color chart A acquired by the color sensor 200 and the colorimetric device 400.

An example of a calculation method of the correction coefficient will be described below. The conversion condition generation unit 330 acquires a correlation of spectral data at each of the measurement images.

$$\Delta L = L2^* - L1^* \quad (1)$$

$$\Delta a = a2^* - a1^* \quad (2)$$

$$\Delta b = b2^* - b1^* \quad (3)$$

Herein, the spectral data acquired by the color sensor 200 are expressed as L1*, a1*, and b1*, whereas the spectral data acquired by the colorimetric device 400 are expressed as L2*, a2*, and b2*. The correlation data ΔL, Δa, and Δb are the correction coefficients.

In step S605, the CPU 300 stores the correction coefficients calculated in step S604 in the HDD 303. Then, the CPU 300 displays a message indicating completion of registration of the correction coefficients on the liquid crystal display of the operation unit 180 and ends the sensor correction coefficient generation processing.

Figure 10D:
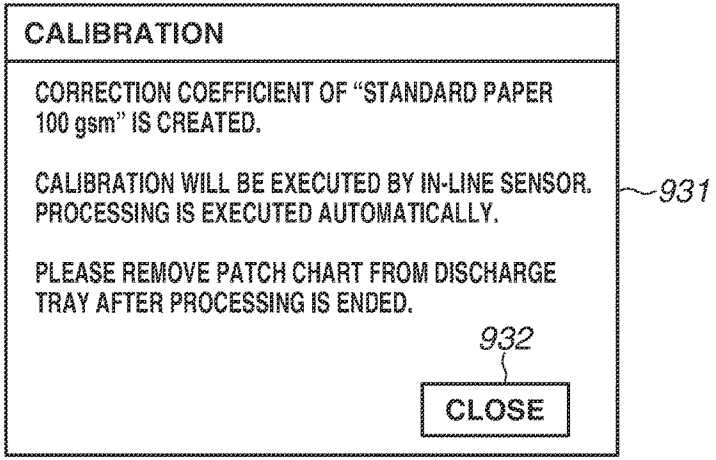

FIG. 10D is a diagram schematically illustrating a screen 931 displayed on the operation unit 180 after the sensor correction coefficient creation processing is completed. A message which notifies the user that the sensor correction coefficients corresponding to the target sheet are created normally, and that the first calibration processing (in step S505) is automatically executed is displayed on the screen 931. Then, when the user presses a button 932, the CPU 300 displays a home screen on the liquid crystal display of the operation unit 180.

<First Calibration Processing>

Figure 3C:
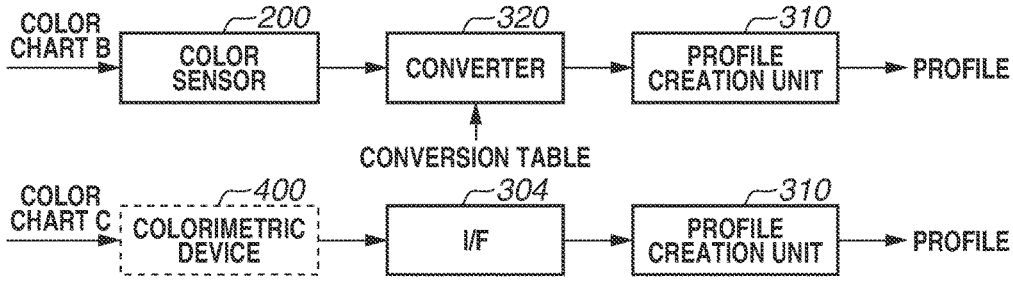
FIG. 3C is a schematic diagram illustrating a relationship of data input and output through first calibration processing.
Figure 3D:
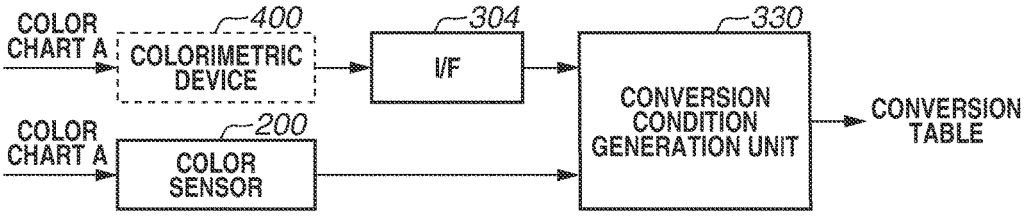
FIG. 3D is a schematic diagram illustrating a relationship of data input and output through correction information generation processing.
Figure 8:
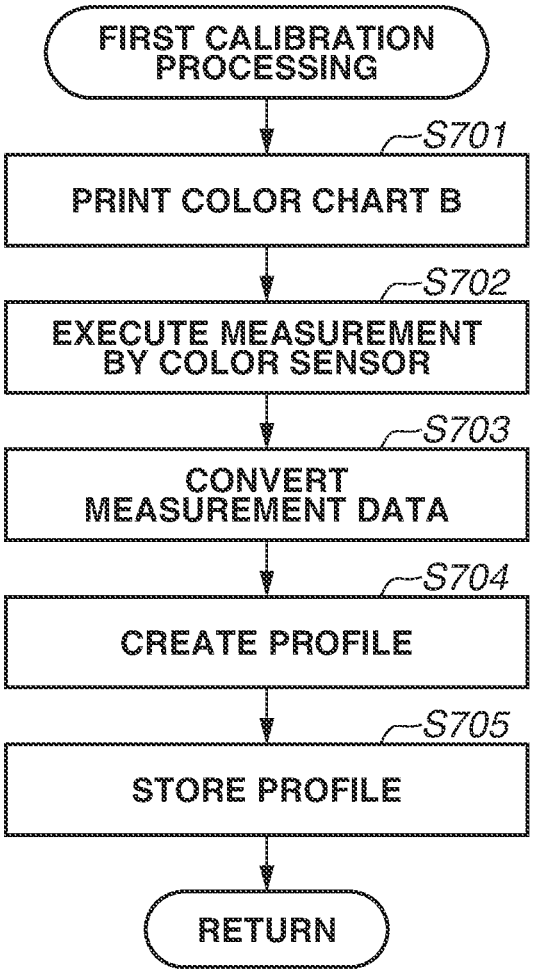
FIG. 8 is a flowchart illustrating profile creation processing using the colorimetric device.

The first calibration processing executed in step S505 will be described with reference to FIG. 3C and FIG. 8.

In step S701, the CPU 300 controls the printer 101 to form a color chart B on the sheet 110. The CPU 300 controls the pattern generator 309 to transfer the measurement image data corresponding to the color chart B to the printer 101 via the gradation correction unit 307. With this processing, the printer 101 forms the color chart B on the sheet 110 based on the measurement image data. The color chart B is a color chart for the color sensor 200. A layout of the color chart B will be described below with reference to FIG. 11B.

In step S702, the CPU 300 controls the motor 305 to convey the color chart B to the conveyance path 135 and controls the color sensor 200 to measure the color chart B. A measurement result of the color chart B acquired by the color sensor 200 is transferred to the converter 320.

In step S703, the converter 320 corrects the measurement result acquired in step S702 based on the correction coefficients ΔL, Δa, and Δb stored in the HDD 303. The converter 320 may execute the following calculation processing to convert the spectral data L1*, a1*, and b1* acquired by the color sensor 200 into the spectral data L12*, a12*, and b12* of the colorimetric device 400. The spectral data L12*, a12*, and b12* correspond to the first measurement data.

$$L12^* = L1^* + \Delta L \quad (4)$$

$$a12^* = a1^* + \Delta a \quad (5)$$

$$b12^* = b1^* + \Delta b \quad (6)$$

Then, the spectral data L12*, a12*, and b12* are transferred to the profile creation unit 310. In step S704, the profile creation unit 310 creates a profile based on the spectral data L12*, a12*, and b12* of each of the measurement images acquired from the color chart B.

In step S705, the CPU 300 stores the profile created by the profile creation unit 310 in step S704 in the HDD 303. Then, the CPU 300 completes the first calibration processing.

<Second Calibration Processing>

Figure 9:
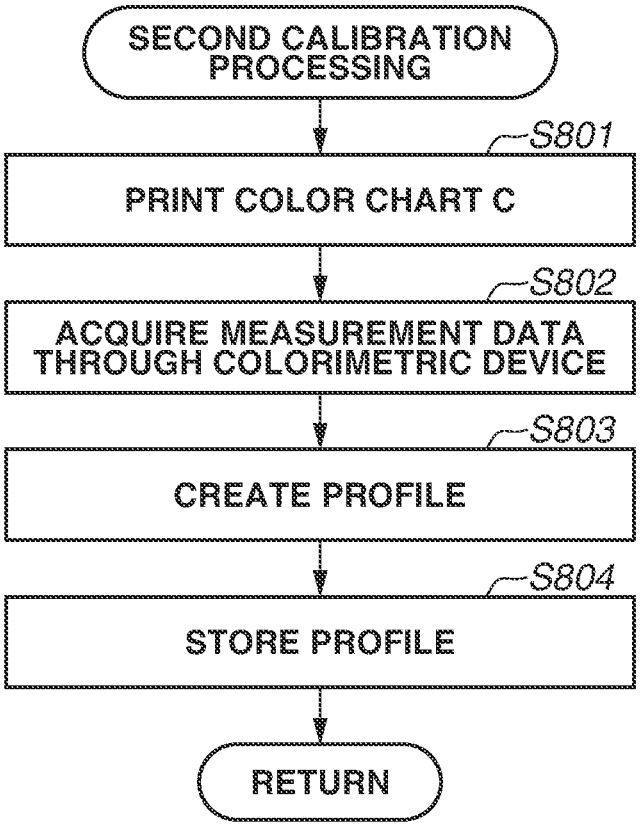
FIG. 9 is a flowchart illustrating profile creation processing using the color sensor.

The second calibration processing executed in step S506 will be described with reference to FIG. 3C and FIG. 9.

In step S801, the CPU 300 controls the printer 101 to form a color chart C on the sheet 110. The CPU 300 controls the pattern generator 309 to transfer the measurement image data corresponding to the color chart C to the printer 101 via the gradation correction unit 307. With this processing, the printer 101 forms the color chart C on the sheet 110 based on the measurement image data. The color chart C is a color chart for the colorimetric device 400. A layout of the color chart C will be described below with reference to FIG. 11C. In addition, the color sensor 200 does not measure the color chart C when the second calibration processing is executed.

In step S802, the CPU 300 waits for the spectral data L2*, a2*, and b2* of the color chart C acquired by the colorimetric device 400 to be received via the I/F 304. In step S802, the CPU 300 determines that the spectral data L2*, a2*, and b2* are received when a button 922 in the screen 921 displayed on the operation unit 180 is pressed. Then, the processing proceeds to step S803.

In step S803, the spectral data L2*, a2*, and b2* are transferred to the profile creation unit 310. Then, the profile creation unit 310 creates a profile based on the spectral data L2*, a2*, and b2* of each of the measurement images acquired from the color chart C.

In step S804, the CPU 300 stores the profile created by the profile creation unit 310 in step S803 in the HDD 303. Then, the CPU 300 completes the second calibration processing.

<Description of Color Chart>

Figure 11A:
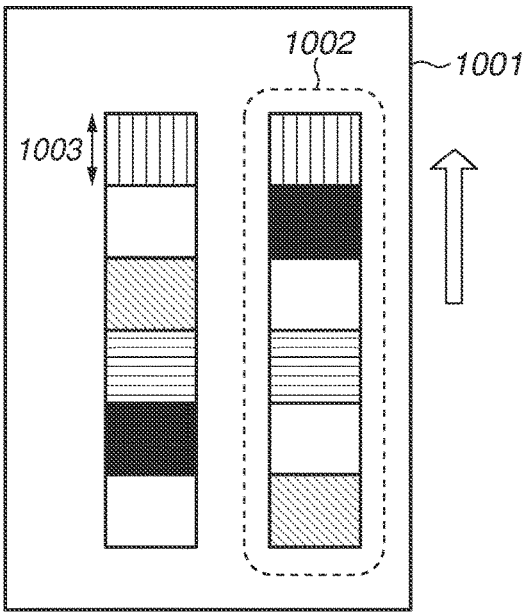
FIGS. 11A, 11B, and 11C are schematic diagrams illustrating color charts A, B, and C, respectively.
Figure 11B:
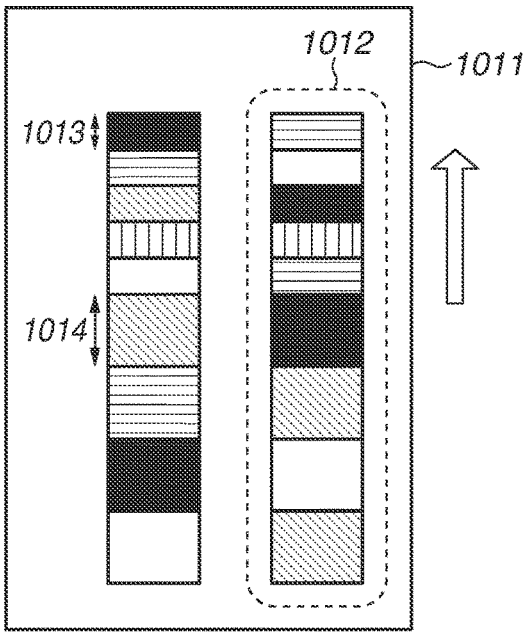

The color charts formed on the sheets 110 by the image forming apparatus 100 through the processing in FIGS. 7, 8, and 9 will be described with reference to FIGS. 11A to 11C. The color charts (color charts A and B) illustrated in FIGS. 11A and 11B are stored in the HDD 303. The CPU 300 reads measurement image data for forming the color chart from the HDD 303 as necessary, and transfers the measurement image data to the pattern generator 309.

FIG. 11A illustrates an example of a layout of the color chart (common chart) A of the present exemplary embodiment. Hereinafter, the sheet 110 on which the color chart A is formed is called as a test sheet 1001. The test sheet 1001 may have the following characteristics.

The number of measurement image arrays 1002 is the same as the number of color sensors 200. A plurality of measurement images is arrayed in each of the measurement image arrays 1002. For example, the number of measurement images formed in one measurement image array 1002 may be 16 pieces.

Further, in the test sheet 1001, a length 1003 of a measurement image in the conveyance direction is longer than a length of a measurement image measurable by the color sensor 200 or the colorimetric device 400. For example, the length 1003 of a measurement image is 22 mm. For example, the number of measurement images formable on the A3-size sheet 110 is 32 pieces.

FIG. 11B illustrates an example of a layout of the color chart B of the present exemplary embodiment. Hereinafter, the sheet 110 on which the color chart B is formed is called as a test sheet 1011. The test sheet 1011 may have the following characteristics.

The number of measurement image arrays 1012 is the same as the number of color sensors 200. A plurality of measurement images is arrayed in each of the measurement image arrays 1012. For example, the number of measurement images formed in each of the measurement image arrays 1012 is 19 pieces.

Further, the measurement image array 1012 includes measurement images having different lengths in the conveyance direction. In the present exemplary embodiment, the measurement image array 1012 includes measurement images in two different lengths. In the test sheet 1011, each of lengths 1013 and 1014 of the measurement images in the conveyance direction is longer than a length of a measurement image measurable by the color sensor 200.

For example, the length 1013 of a measurement image in the conveyance direction is 14 mm. For example, the length 1014 of a measurement image in the conveyance direction is 20 mm. The color sensor 200 measures the plurality of measurement images when the test sheet 1011 is being conveyed. The conveyance rollers 140*a* and 140*b* rotate at a predetermined rotation speed. However, unevenness arises in conveyance of the sheet 110 conveyed by the conveyance rollers 140*a* and 140*b*. Accordingly, a size (length) of a measurement image arrayed on a side of the trailing end of the test sheet 1011 is set to be longer than a size (length) of a measurement image arrayed on a side of the leading end of the test sheet 1011 in the conveyance direction. With this configuration, the number of measurement images formable on the test sheet 1011 in the conveyance direction is secured.

Figure 11C:
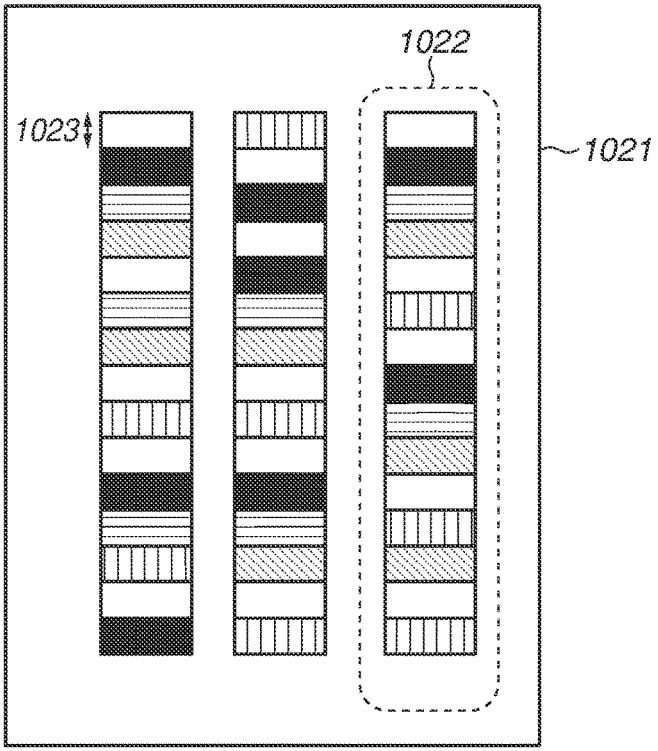

FIG. 11C illustrates an example of a layout of the color chart C of the present exemplary embodiment. Hereinafter, the sheet 110 on which the color chart C is formed is called as a test sheet 1021. The test sheet 1021 may have the following characteristics.

A plurality of measurement images is arrayed in each of the measurement image arrays 1022. For example, the number of measurement images formed in each of the measurement image arrays 1022 is 20 pieces. Further, a size of the measurement image arrayed on the test sheet 1021 can be equal to or greater than a size measurable by the colorimetric device 400. Furthermore, for example, a size 1023 of a measurement image on the test sheet 1021 is 10 mm because the user manually moves the colorimetric device 400. In other words, the number of measurement images formable on the A3-size sheet 110 is greater than in the case of the other color charts (i.e., color charts A and B). Therefore, if measurement images of the same number are measured by the first and the second calibration processing, the number of sheets 110 necessary for the second calibration processing is less than the number of sheets necessary for the first calibration processing.

According to the present invention, the color chart appropriate for the colorimetric device for measuring the color chart can be formed.

Further, the number of measurement images formable on the test sheet 1001 is less than the number of measurement images formable on the test sheet 1011. Furthermore, the number of measurement images formable on the test sheet 1001 is less than the number of measurement images formable on the test sheet 1021.

In addition, in the above-described exemplary embodiments, although the length 1003 of a measurement image on the test sheet 1001 is set to be shorter than the length 1014 of a measurement image on the test sheet 1011, the lengths 1003 and 1014 of the measurement images can be equal to each other.

According to the present disclosure, color charts appropriate for various types of calibration can be formed.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2017-108240, filed May 31, 2017, which is hereby incorporated by reference herein in its entirety.

What is claimed is:

1. An image forming apparatus to which an external measurement device is connectable, the image forming apparatus comprising:

an image processor configured to perform image processing to image data;

a printer configured to print an image on a sheet based on the image data;

a sensor arranged on a conveyance path for conveying the sheet on which the image is formed and configured to measure a measurement image printed on the sheet by the printer; and a controller configured to:

execute first processing for generating a color processing condition to be used for the image processing, based on a measurement result acquired by the sensor from measurement images printed by the printer, the measurement images including a first measurement image and a second measurement image, wherein a length of the second measurement image in a conveyance direction is longer than a length of the first measurement image in the conveyance direction, and execute second processing for generating a conversion condition, based on a measurement result acquired by the sensor from predetermined measurement images printed by the printer, wherein a length of a predetermined measurement image included in the predetermined measurement images in the conveyance direction is longer than the length of the first measurement image in the conveyance direction, wherein the first processing includes:

a first printing task that controls the printer to print the measurement images on a first sheet;

a first measuring task that controls the sensor to measure the measurement images on the first sheet;

a conversion task that converts a first measurement result of the measurement images based on the conversion condition, the first measurement result being acquired by the sensor; and a first generation task that generates the color processing condition based on the converted first measurement result, and wherein the second processing includes:

a second printing task that controls the printer to print the predetermined measurement images on a second sheet;

a second measurement task that controls the sensor to measure the predetermined measurement images on the second sheet; and a second generation task that generates the conversion condition based on a second measurement result acquired by the sensor from the predetermined measurement images and measurement data output from an external measurement device, wherein the measurement data corresponds to a measurement result acquired by the external measurement device from the predetermined measurement images on the second sheet.

2. The image forming apparatus according to claim 1, wherein the color processing condition includes a profile.

3. The image forming apparatus according to claim 1, wherein a number of the predetermined measurement images printed on the second sheet is less than a number of the measurement images printed on the first sheet.

4. The image forming apparatus according to claim 1, wherein a position where the first measurement image on the first sheet is formed in the conveyance direction is different from a position where the second measurement image on the first sheet is formed in the conveyance direction.

5. The image forming apparatus according to claim 1, wherein the first measurement image is printed on the first sheet at a position on a downstream side of the second measurement image in the conveyance direction.

6. The image forming apparatus according to claim 1, wherein the controller executes third processing for generating the color processing condition based on other measurement data output from the external measurement device, wherein the third processing includes:

a third printing task that controls the printer to print other measurement images on a third sheet; and a third generating task that generates the conversion condition based on the other measurement data output from the external measurement device, wherein the other measurement data corresponds to a measurement result acquired by the external measurement device from the other measurement images on the third sheet.

7. The image forming apparatus according to claim 6, wherein a length of the predetermined measurement image in the conveyance direction is longer than a length of a measurement image among the other measurement images in the conveyance direction.

8. The image forming apparatus according to claim 6, wherein a length of the second measurement image in the conveyance direction is longer than a length of a measurement image among the other measurement images in the conveyance direction.

9. The image forming apparatus according to claim 6, wherein a length of the first measurement image in the conveyance direction is longer than a length of a measurement image among the other measurement images in the conveyance direction.

10. The image forming apparatus according to claim 6, wherein a number of the predetermined measurement images printed on the second sheet is less than a number of the measurement images printed on the first sheet, and wherein a number of the predetermined measurement images printed on the second sheet is less than a number of the other measurement images printed on the third sheet.

11. An image forming apparatus to which an external measurement device is connectable, the image forming apparatus comprising:

an image processor configured to perform image processing to image data;

a printer configured to print an image on a sheet based on the image data;

a sensor arranged on a conveyance path for conveying the sheet on which the image is formed, configured to measure a measurement image printed on the sheet by the printer; and a controller configured to:

control the printer to print predetermined measurement images;

control the sensor to measure the predetermined measurement images;

generate a conversion condition, based on a measurement result acquired by the sensor from the predetermined measurement images and measurement data output from the external measurement device, wherein the measurement data corresponds to the measurement result acquired by the external measurement device from the predetermined measurement images;

control the printer to print measurement images including a first measurement image and a second measurement image, wherein a length of the second measurement image in the conveyance direction is longer than a length of the first measurement image in the conveyance direction, and wherein a length of the first measurement image in the conveyance direction is shorter than a length of a predetermined measurement image among the predetermined measurement images in the conveyance direction;

control the sensor to measure the measurement images;

convert a measurement result of the measurement images acquired by the sensor, based on the generated conversion condition; and generate a color processing condition used for the image processing, based on the converted measurement result.

12. A control method of an image forming apparatus, to which an external measurement device is connectable, including a printer configured to print an image on a sheet based on image data, and a sensor arranged on a conveyance path for conveying a sheet on which an image is formed and configured to measure a measurement image printed on the sheet by the printer, the external measurement device being different from the sensor, the control method comprising:

printing a predetermined measurement images by the printer;

measuring the predetermined measurement images by the sensor;

generating a conversion condition based on a measurement result acquired by the sensor from the predetermined measurement images and measurement data output from the external measurement device, wherein the measurement data corresponds to the measurement result acquired by the external measurement device from the predetermined measurement images;

printing, by the printer, measurement images including a first measurement image and a second measurement image, wherein a length of the second measurement image in the conveyance direction is longer than a length of the first measurement image in the conveyance direction, and wherein a length of the first measurement image in the conveyance direction is shorter than a length of a predetermined measurement image among the predetermined measurement images in the conveyance direction;

measuring the measurement images by the sensor;

converting a measurement result acquired by the sensor from the measurement images based on the generated conversion condition; and generating a color processing condition based on the converted measurement result, wherein the color processing condition is used for executing image processing on image data.

* * * * *